US006097155A

United States Patent [19]

Vollkommer et al.

[11] Patent Number: 6,097,155

[45] Date of Patent: Aug. 1, 2000

[54] FLUORESCENT LAMP

[75] Inventors: Frank Vollkommer, Buchendorf; Lothar Hitzschke; Simon Jerebic, both of Munich, all of Germany

[73] Assignee: Patent-Treuhand-Gesellschaft fuer elektrische Gluehlampen mbH, Munich, Germany

[21] Appl. No.: 09/202,616

[22] PCT Filed: Apr. 16, 1998

[86] PCT No.: PCT/DE98/01061

§ 371 Date: Dec. 18, 1998

§ 102(e) Date: Dec. 18, 1998

[87] PCT Pub. No.: WO98/49712

PCT Pub. Date: Nov. 5, 1998

[30] Foreign Application Priority Data

Apr. 30, 1997 [DE] Germany ..... 197 18 395

[51] Int. Cl.[7] ..... H01J 7/44

[52] U.S. Cl. ..... 315/58; 315/DIG. 1; 313/234

[58] Field of Search ..... 315/326, 260, 315/334, 358, 169.1, DIG. 4, DIG. 5, DIG. 1, 224, 287, 246, 58, 56, 313; 313/485, 488, 491, 492, 493, 494, 569, 572, 234, 607

[56] References Cited

U.S. PATENT DOCUMENTS

| | | | |
|---|---|---|---|
| 5,757,132 | 5/1998 | Matsuno et al. | 313/607 |
| 5,763,999 | 6/1998 | Matsuno et al. | 313/573 |
| 5,886,468 | 3/1999 | Terada et al. | 313/607 |
| 5,932,960 | 8/1999 | Terada et al. | 313/485 |

*Primary Examiner*—Haissa Philogene
*Assistant Examiner*—Ephrem Alemu
*Attorney, Agent, or Firm*—Carlo S. Bessone

[57] ABSTRACT

A fluorescent lamp (1) having a tubular discharge vessel (2), filled with inert gas, and a fluorescent layer (6) has elongated electrodes (3; 4; 12; 14*a*–14*d*) arranged parallel to the longitudinal axis of the tubular discharge vessel (2), at least one electrode (4; 12; 14*a*–14*d*) being arranged on the inner wall of the discharge vessel (2). The tubular discharge vessel (2) is sealed in a gas-tight fashion at one or at both ends with a stopper (8) and by means of solder (9), the at least one inner wall electrode (4) being guided to the outside in a gas-tight fashion through the solder (9). Alternatively or also in addition, at least one electrode (16) is arranged inside the wall of the discharge vessel (2). Up to a maximum of the entire inside diameter can be used as striking distance, depending on the positioning of the associated counterelectrode(s). High luminous densities are achieved because of the large and, at the same time, constant striking distance along the discharge tube. The lamp is provided for a pulsed, dielectrically impeded discharge.

17 Claims, 5 Drawing Sheets

FLUORESCENT LAMP

TECHNICAL FIELD

The invention relates to a fluorescent lamp and a lighting system using the fluorescent lamp.

Under discussion here are fluorescent lamps in which either the electrodes of one polarity or all the electrodes, that is to say those of either polarity, are separated from the discharge by means of a dielectric layer (unilaterally or bilaterally dielectrically impeded discharge). Such electrodes are also denoted below as "dielectric electrodes" for short.

The dielectric layer can be formed by the wall of the discharge vessel itself by arranging the electrodes outside the discharge vessel, for example on the outer wall. One advantage of this design with external electrodes is that no gas-tight electrical feedthroughs need be guided through the wall of the discharge vessel. However, the thickness of the dielectric layer—an important parameter which influences, inter alia, the starting voltage and the operating voltage of the discharge—is essentially fixed by the requirements placed on the discharge vessel, in particular its mechanical strength. Since the level of the required supply voltage increases with the thickness of the dielectric layer, there are the following disadvantages, inter alia. Firstly, the voltage supply provided for operating the flat radiator must be designed for the higher voltage requirement. As a rule, this is associated with additional costs and larger outside dimensions. Moreover, more stringent safety preparations are required for shock protection. Finally, undesirably high electromagnetic radiations can become problematical.

On the other hand, the dielectric layer can also be implemented in the form of an at least partial covering or layer of at least one electrode arranged inside the discharge vessel. This has the advantage that the thickness of the dielectric layer can be optimized to the discharge characteristics. However, internal electrodes require gas-tight electrical feedthroughs. Additional production steps are required as a result, and this generally means more expensive production.

Of particular concern here, moreover, are fluorescent lamps with a tubular discharge vessel which is sealed at both ends and whose inner wall is coated at least partially with a fluorescent material.

Such lamps are used, in particular, in equipment for office automation (OA), for example colour copiers and colour scanners, for signal lighting, for example as brake indicator lights and direction indicator lights in automobiles, for auxiliary lighting, for example the interior lighting of automobiles, and for background lighting of displays, for example liquid crystal displays, as so-called edge type backlights.

These technical fields of application require both particularly short starting phases, but also luminous fluxes which are as independent as possible of temperature. These lamps therefore contain no mercury. Rather, these lamps are usually filled with an inert gas, preferably xenon, or mixtures of inert gases.

The said applications require both a high luminous density and a luminous density which is uniform over the length of the lamp. In order to increase the luminous density, lamps for use in OA are usually provided with an aperture along the longitudinal axis. It is not sufficient for the purpose of raising the luminous density further to increase the power input into previous systems, since it is impossible to raise the loading of a lamp arbitrarily for permanent and reliable operation. A further complication is that the efficiency of the discharge decreases with increasing power input in the systems previously used in copiers and scanners.

PRIOR ART

An inert gas discharge lamp for OA equipment is already known from publication U.S. Pat. No. 5,117,160. Two strip-shaped electrodes are arranged along the lamp longitudinal axis on the outer surface of the wall of a tubular discharge vessel. The lamp is operated with AC voltage at a preferred frequency of between 20 kHz and 100 kHz. The 147 nm xenon line is excited in operation. A disadvantage is an incompletely transparent protective layer, which is required, inter alia, for reasons of shock protection and covers both the electrode strips and the remaining lamp surface. To be precise, the electrodes, which are alternately at a high voltage potential (for example, approximately 1600 V), would be freely accessible without this protective layer. Moreover, the protective layer has a further function of suppressing parasitic surface creeping discharges. Further disadvantages result from the relatively high operating voltages required to operate with external electrodes. Specifically, undesirably high electromagnetic radiations are associated therewith, on the one hand. On the other hand, an electronic ballast must be designed to the relatively high operating voltages required to operate the lamp, and this generally raises the cost of producing said ballasts. Finally, the useful radiation efficiency achievable with the mode of operation employed, and thus the resulting luminous density are relatively low.

It is known, moreover, from U.S. Pat. No. 5,604,410 that the efficiency of dielectrically impeded discharges can be substantially raised by contrast with the dielectrically impeded discharges excited by AC voltage (see U.S. Pat. No. 5,117,160) with the aid of a pulse control operation (pulsed, dielectrically impeded discharge) adapted to the special conditions (striking distance, electrode configuration, electrode geometry and filling pressure).

Furthermore, U.S. Pat. No. 5,604,410 discloses a tubular discharge lamp with a circular cross-section, with a strip-shaped external electrode and a bar-shaped internal electrode. With the aid of two bow-shaped supply leads, the bar-shaped internal electrode is arranged eccentrically in the vicinity of the inner wall and parallel to the longitudinal axis of the discharge vessel. The two supply leads are guided to the outside via one pinch in each case, which is connected in a gas-tight fashion to the discharge vessel by means of a plate seal. The external electrode is fixed diametrically opposite on the outer wall. The relatively complicated and therefore expensive structure for fastening the metallic electrode bar in the interior of the lamp, and the two pinches are disadvantageous. Moreover, the metallic inner electrode bar must be of relatively thick design in order to ensure the required stiffness. On the other hand, there is a risk of the internal electrode bar sagging, and thus of the striking distance along the electrodes not being sufficiently constant. A tensioned wire as inner electrode would not solve the problem, since it heats up during the lamp operation and therefore sags properly. For these reasons, the said lamp requires a relatively large diameter, but this conflicts with use for specific purposes, in particular for office automation and signal lighting in automobiles.

DESCRIPTION OF THE INVENTION

It is the object of the present invention to eliminate the said disadvantages and to provide a fluorescent lamp which has an improved luminous density.

The basic idea of the invention is based on the finding that, on the one hand, the striking distance of the pulsed, dielectrically impeded discharge is to be as large as possible for a high electric power input. On the other hand, the arrangement of all the electrodes on the outer wall of the discharge vessel is to be avoided, in conjunction with the disadvantages associated therewith. Moreover, as constant a striking distance as possible along the discharge tube is to be aimed at for the pulsed, dielectrically impeded discharge. This is important for ensuring the same starting conditions during operation for all individual discharges (see U.S. Pat. No. 5,604,410 in this regard) along the electrodes. Specifically, it is ensured thereby that the individual discharges are formed in a row along the entire electrode length (assuming an adequate input electric power) and that, consequently, a basic precondition is fulfilled for achieving a high and homogeneous luminous density of the lamp.

A first approach according to the invention for solving this problem proposes arranging at least one or all the electrodes on the inner wall of the discharge vessel. Such an electrode is denoted below as an "inner wall electrode" for short. Depending on the positioning of the associated counterelectrode(s), up to at most the entire inner diameter can be used as striking distance through this concept. One advantage is, inter alia, the good thermal coupling of the electrodes via the material of the vessel to the outside. It is ensured thereby that the inner wall electrodes do not become detached from the inner wall even in continuous operation. The striking distance therefore remains constant.

The inner wall electrode is constructed as an electrically conductive, possibly "linear" strip—resembling an electric conductor track—and orientated parallel to the longitudinal axis of the tubular discharge vessel. The strip can be applied to the inner wall in the form of liquid conductive silver or the like, for example. The strip is subsequently solidified, for example by burning in. The inner wall electrode is additionally also developed further as a feedthrough, including an external supply lead. For this purpose, the tubular discharge vessel is sealed at least at one of its two ends by a stopper which is connected in a gas-tight fashion to the inner wall of the vessel end by means of solder, for example glass solder. The inner wall electrode is guided to the outside in a gas-tight fashion through the solder, that is to say the inner wall electrode merges in the region of the solder into a feedthrough and, finally, merges into an external supply lead outside the vessel. In this way, the inner wall electrode, the associated feedthrough thereof and the associated external supply lead are constructed in each case as functionally differing subregions of a unilateral common structure resembling a conductor track. This structure represents a key to implementing the inner wall electrode. Specifically, this concept can be implemented in a simple way and with relatively few components and can, moreover, be effectively automated.

In order to keep mechanical stresses due to different thermal expansions low, and to ensure gas-tightness even during continuous operation, the materials for the glass solder and discharge vessel are tailored to one another. Moreover, the thickness of the conductor track (electrode, feedthrough, supply lead) is selected to be so thin that, on the one hand, the thermal stresses remain low and that, on the other hand, the current intensities required during operation can be realized.

In this case, a sufficiently high current carrying capacity of the conductor track requires a particular importance since the high luminous intensities aimed at for such lamps finally require high current intensities. This problem is further heightened in the case of the preferred pulsed mode of operation of the discharge, since particularly high currents flow in the conductor tracks during the relatively short duration of the repetitive injection of effective power. It is only in this way that it is also possible to inject sufficiently high average effective powers and thereby to achieve the desired high luminous intensity on average over time.

A relatively thick conductor track is used for the at least one inner wall electrode in order to ensure the abovementioned high current carrying capacity. Specifically, an excessively low conductor track thickness runs the risk of the formation of cracks because of local overheating of the conductor track. The heating of the conductor track by the ohmic component of the conductor track current is the greater the smaller the cross-section of the conductor track. Reasons of space set limits to the width of the conductor track, however, especially in the case of very slim lamps with relatively small diameters. Consequently, the aim is rather conductor tracks which are narrow, but for this reason rather thick, in order to solve the problem of the formation of cracks because of the development of heat by high current densities in the conductor tracks. Typical thicknesses for conductive silver strips are in the region of approximately 5 $\mu$m to approximately 50 $\mu$m, preferably in the region of approximately 5.5 $\mu$m to approximately 30 $\mu$m, particularly preferably in the region of approximately 6 $\mu$m to approximately 15 $\mu$m.

Furthermore, according to the invention one or more further electrodes are arranged on the outer wall or, likewise, on the inner wall. Moreover, at least a part of the inner wall has a fluorescent layer. Only a strip-shaped aperture remains uncoated for OA applications. In addition, one or more reflective layers for visible light, made from $Al_2O_3$ and/or $TiO_2$, for example, can be applied below the fluorescent layer. If appropriate, this prevents a portion of the light emitted by the fluorescent layer from being transmitted through the vessel wall. Rather, the light is directed essentially onto the aperture by reflection or multiple reflection, and the luminous density consequently increases there. Alternatively, the fluorescent layer can also itself additionally be co-used as reflective layer by applying the fluorescent layer with adequate thickness.

In a first simple design, the fluorescent lamp has two electrodes, one strip-shaped electrode each being arranged on the outer and inner walls, respectively. If the lamp is provided for operation with bipolar voltage pulses, the inner wall electrode is additionally covered completely by a dielectric layer. This bilateral dielectric impediment is not mandatory for operation with unipolar voltage pulses (see U.S. Pat. No. 5,604,410 in this regard). In order to ensure shockproofness, in the latter case the inner wall electrode is connected to a high-voltage potential.

In one variant, both electrodes are arranged on the inner wall of the discharge vessel, at least one of the two electrodes being completely covered by a dielectric layer. If the lamp is to be operated with bipolar voltage pulses, both electrodes are correspondingly coated dielectrically.

Because of the two electrodes, in both variants one discharge plane each is produced and extends between the two electrodes inside the discharge vessel. Arranged in a row in this plane next to one another along the electrodes are a multiplicity of individual discharges which merge in the limiting case into a type of curtain-like discharge structure. In order to increase the luminous density of the lamp, further discharge planes can be generated inside the discharge vessel. The lamp has three or more electrodes for this purpose. Three electrodes suffice to generate two discharge planes which have a common electrode. This is preferably in the case of unipolar voltage pulses the (temporary) cathode, and the two other electrodes are connected as anodes. With four electrodes it is possible to implement either two independent discharge planes or else three discharge planes with a common electrode, depending on whether the four electrodes are connected as two cathodes and two anodes or else as one cathode and three anodes. It is possible in principle to generate more than three discharge planes in this way. However, in practice reasons of space set certain limits to the required number of electrode strips.

If the lamp is provided for OA applications and is consequently provided with an aperture, the electrodes are advantageously orientated such that, seen in cross-section, the mid-verticals of the respective discharge planes intersect the fluorescent layer. This ensures that the UV (ultraviolet) radiation maximum of the discharge plane falls onto the fluorescent layer.

A second approach according to the invention for solving the abovenamed problem proposes arranging at least one electrode inside the wall of the discharge vessel. Such an electrode is denoted below as "vessel wall electrode" for short. Here, as well, it is possible to use up to a maximum of the entire inside diameter as striking distance, depending on the positioning of the associated counter-electrode(s). The advantage of this solution is that there is no need for an additional dielectric even in the case of operation with bipolar voltage pulses. Specifically, the dielectric layer which is active for the discharge is formed here by a part of the vessel wall itself, to be precise by that part of the wall which covers the electrode in the direction towards the interior of the discharge vessel. The thickness of the active dielectric layer is fixed here by the depth at which the electrode is recessed into the vessel wall. However, it is also necessary in consequence for the electrode to be recessed very uniformly, for example in the form of a straight wire, into the vessel wall. Thus, care must be taken that the thickness of the covering of the electrode by the vessel material (dielectric!) is as constant as possible over the length of the tube. Otherwise, the result is, specifically, that there are different layer thicknesses of the active dielectric along the inner wall electrode, and therefore an undesired and non-uniform discharge structure of lower efficiency for generating useful radiation. Otherwise, the fluorescent lamp according to the second solution has the same features in principle as the fluorescent lamp in accordance with the first solution. In particular, all the variants named there are also conceivable, it merely being the case that the inner wall electrode is replaced by the vessel wall electrode.

Finally, it is also possible to combine the two solutions, that is to say at least one electrode each is arranged both on the inner wall and inside the vessel wall. Furthermore, it is also possible in this case for one or more electrodes to be arranged on the outer wall of the discharge vessel.

The tubular discharge vessel can be straight, but also bent. Since the discharging direction extends essentially perpendicular to the lamp longitudinal axis, virtually any shapes can be realized, in particular including circular ones, without this impairing the discharge.

Located inside the discharge vessel is a gas filling consisting of an inert gas, in particular xenon, or an inert gas mixture.

DESCRIPTION OF THE DRAWINGS

The invention is to be explained in more detail below with the aid of a plurality of exemplary embodiments. In the drawing:

FIGS. 1*a* and 1*b* show the longitudinal section and, respectively, cross-section of an aperture fluorescent lamp 1 for OA applications in a diagrammatic representation. The lamp 1 essentially comprises a tubular discharge vessel 2 with a circular cross-section, and a first and a second strip-shaped electrode 3, 4. With the exception of a rectangular aperture 5, the inner wall of the discharge vessel 2 has a fluorescent layer 6. The discharge vessel 2 is sealed in a gas-tight fashion at its first end by a dome 7 formed from the vessel, and at its second end by means of a stopper 8. The stopper 8 is connected in a gas-tight fashion by means of glass solder 9 to the inner wall of the vessel end. There is xenon at a filling pressure of 160 torrs inside the discharge vessel 2.

Figure 1A:
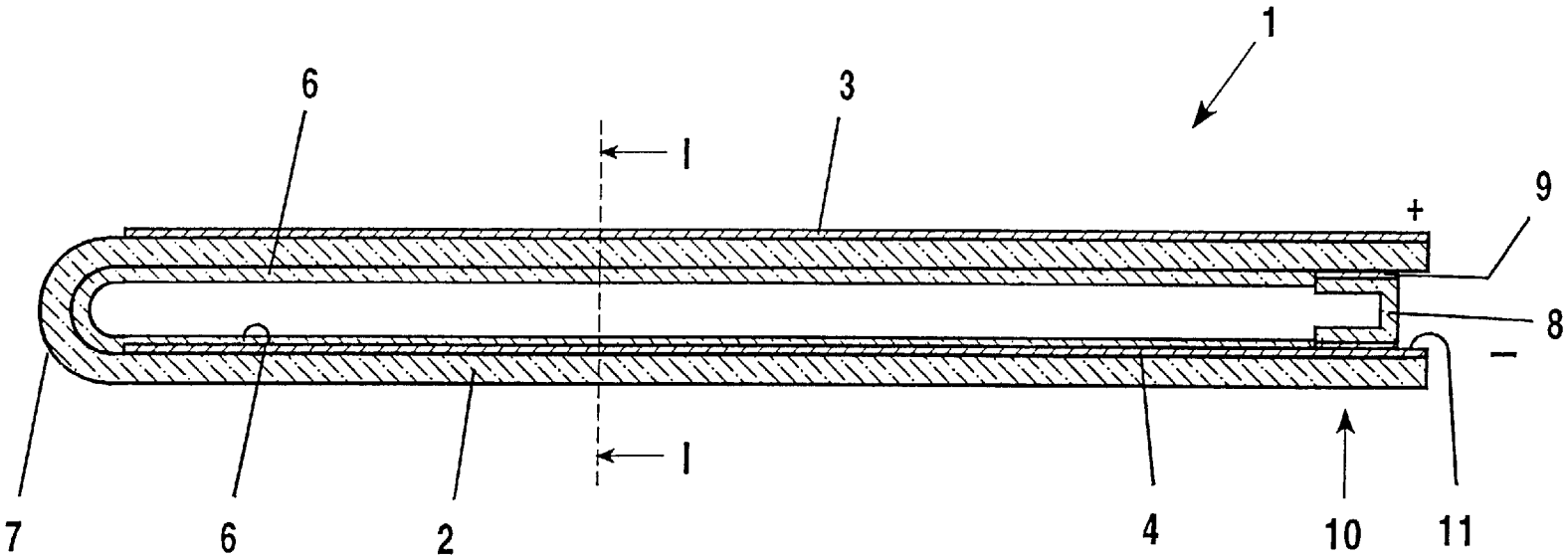
FIG. 1*a* shows a longitudinal section through a fluorescent lamp according to the invention having an aperture and having an outer wall electrode and an inner wall electrode.

The first electrode 3, provided as anode, is constructed as a metal foil strip which is arranged on the outer wall of the discharge vessel 2 parallel to the longitudinal tube axis. The other electrode 4, provided as cathode, comprises a conductive silver strip which is arranged diametrically relative to the anode and applied in a liquid state to the inner wall of the discharge vessel 2 with the aid of a cannula and subsequently burnt in (inner wall electrode). The thickness of the layer is approximately 10 $\mu$m. In a feedthrough region 10 between the stopper 8 and the inner wall of the second end of the discharge vessel 2, the cathode 4 is led through to the outside in a gas-tight fashion and merges there into an external supply lead 11. In this way, the cathode 4, the associated feedthrough 10 thereof and the associated external supply lead are constructed in each case as functionally differing subregions of a unilateral common structure resembling a conductor track. The glass solder 9 enables the cathode 4 to be fed through in a gas-tight fashion in this feedthrough region 10.

The respective width of the anode and cathode strips is 0.9 mm and 0.8 mm, respectively. The outside diameter of the tubular discharge vessel 2 consisting of glass is approximately 9 mm in conjunction with a wall thickness of approximately 0.5 mm. The width and the length of the aperture 5 are approximately 6.5 mm and 255 mm, respectively. The fluorescent layer 6 is a three-band fluorescent material. It consists of a mixture of the blue component $BaMgAl_{10}O_{17}$:Eu, the green component $LaPO_4$:Ce,Tb and the red component $(Y,Gd)BO_3$:Eu. The resulting colour coordinates are x=0.395 and y=0.383, that is to say white light is produced.

Represented diagrammatically in FIGS. 2 to 5 are further cross-sections of a fluorescent lamp according to the invention, similar to the lamp shown in FIG. 1*a*, with and without aperture. They differ from one another essentially by the electrode configuration. In this case, identical features are denoted by identical reference numerals.

Figure 2:
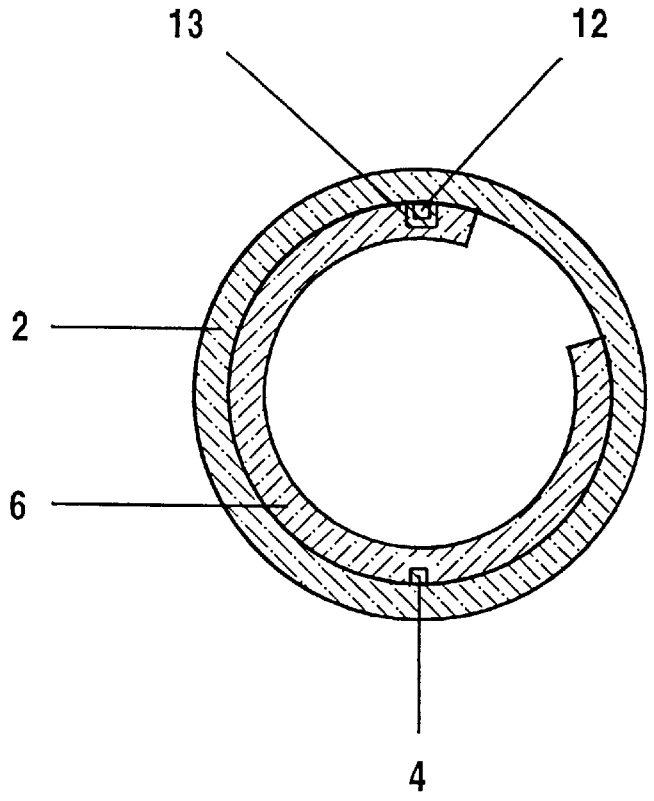
FIG. 2 shows a cross-section through a fluorescent lamp with two inner wall electrodes.

The lamp in FIG. 2 has a first and a second inner wall electrode 12,4. Since both electrodes are located inside the discharge vessel 2, the first electrode 12 is covered by a dielectric layer 13 (unilaterally dielectrically impeded discharge). Said layer is provided as anode in the unipolarly pulsed operation in accordance with U.S. Pat. No. 5,604,410.

Figure 3:
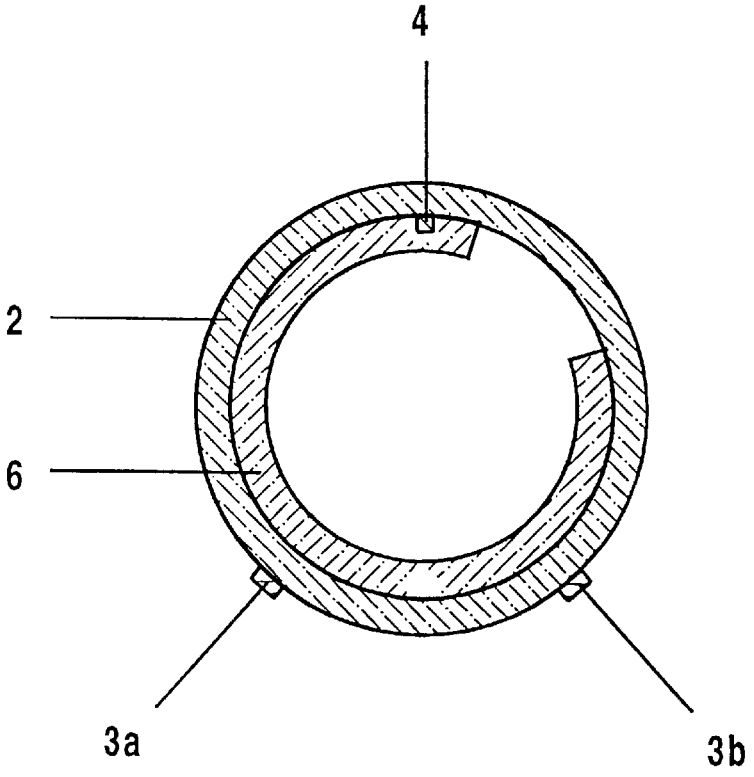
FIG. 3 shows a cross-section through a fluorescent lamp with an inner wall electrode and two outer wall electrodes.

The lamp in FIG. 3 has two outer wall electrodes 3*a*,3*b* and an inner wall electrode 4. The outer wall electrodes 3*a*,3*b* are provided as anodes, and the inner wall electrode 4 is provided as cathode. Consequently, during pulsed operation in accordance with U.S. Pat. No. 5,604,410 two planes (not represented) with one-sidedly dielectrically impeded individual discharges are formed. A first discharge plane extends between the cathode strip 4 and the first anode strip 3*a*. The other discharge plane extends between the cathode strip 4 and the second anode strip 3*b*. Seen in cross-section, the electrodes 3*a*,3*b*,4 are arranged at the corner points of an imaginary equilateral triangle.

Figure 4B:
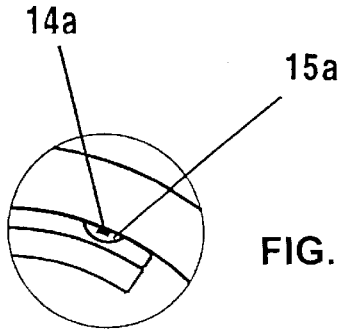
FIG. 4*b* shows a magnified portion of FIG. 4*a*.
Figure 4A:
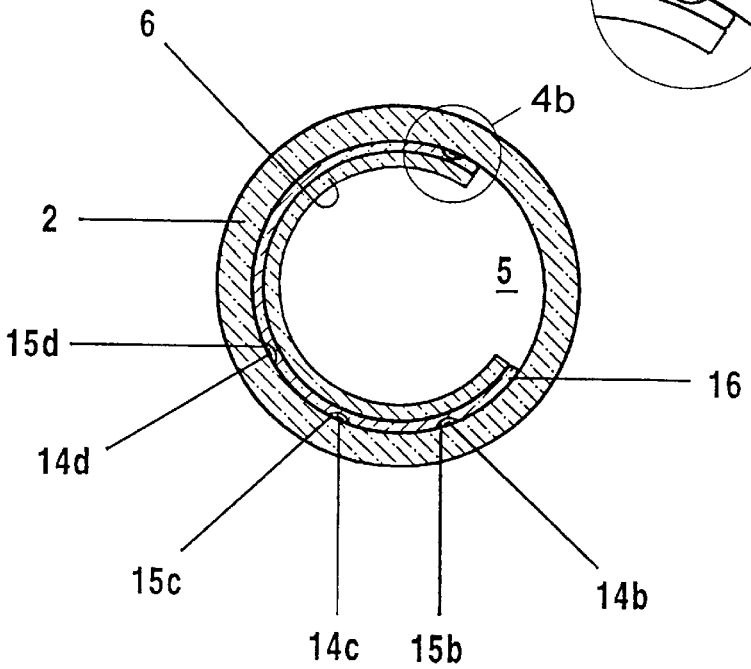
FIG. 4*a* shows a cross-section through a fluorescent lamp with four inner wall electrodes.

The lamp in FIGS. 4*a* and 4*b* has four inner wall electrodes 14*a*–14*d*. Each of the inner wall electrodes 14*a*–14*d*is covered by a dielectric layer 15*a*–15*d*. A first 14*a* of the four electrodes 14*a*–14*d* is provided for a first polarity of a supply voltage, while the three other electrodes 14*b*–14*d* are provided for the second polarity. Consequently, in pulsed operation a total of three discharge planes are formed, to be precise in each case between the first electrode 14*a* and one each of the three remaining electrodes 14*b*–14*d*. Since here the discharge is a bilaterally dielectrically impeded one, it is possible to operate not only with unipolar voltage pulses but also with bipolar voltage pulses. With the exception of the aperture 5, the inner wall of the discharge vessel 2 is provided with a double reflective layer 16 made from $Al_2O_3$ and $TiO_2$. A fluorescent layer 6 is applied to the double reflective layer 16. The double reflective layer 16 reflects the light produced by the fluorescent layer 6. The luminous density of the aperture 5 is increased in this way.

Figure 5:
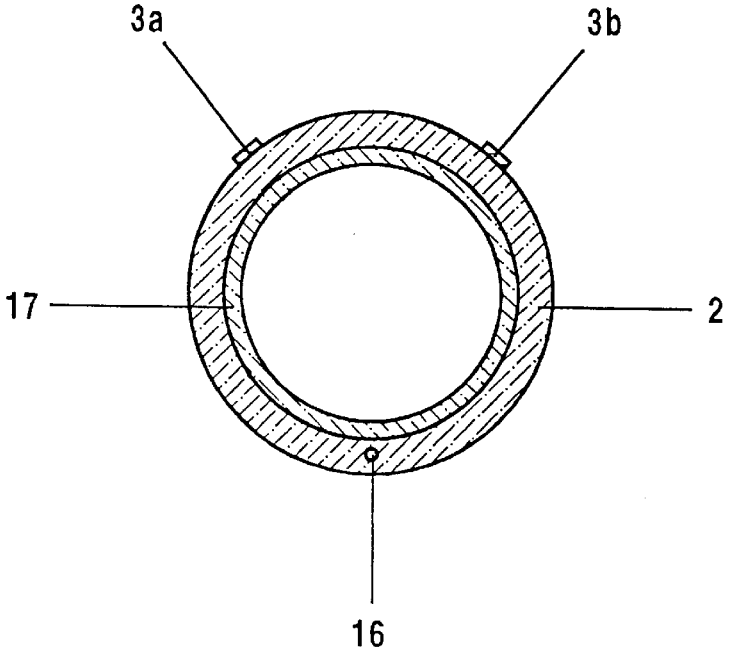
FIG. 5 shows a cross-section through a fluorescent lamp with a vessel wall electrode and two outer wall electrodes.

The lamp in FIG. 5 has two outer wall electrodes 3*a*,3*b*and one vessel wall electrode 4. The vessel wall electrode 4 comprises a wire made from Vacovit® (from Vakuumschmelze GmbH) with a diameter of approximately 100 $\mu$m, which is sealed into the vessel wall. Since, just as in FIGS. 4*a* and 4*b*, all the electrodes are dielectrically impeded here, it is also possible to have bipolar pulsed operation in addition to the unipolar one. The inner wall of the discharge vessel 2 is provided over the entire circumference with a fluorescent layer 17, that is to say by contrast with the previous lamps it has no aperture. The lamp from FIG. 5 is provided for automobile lighting, specifically as brake light or flashing light for example, depending on the fluorescent material.

Figure 6:
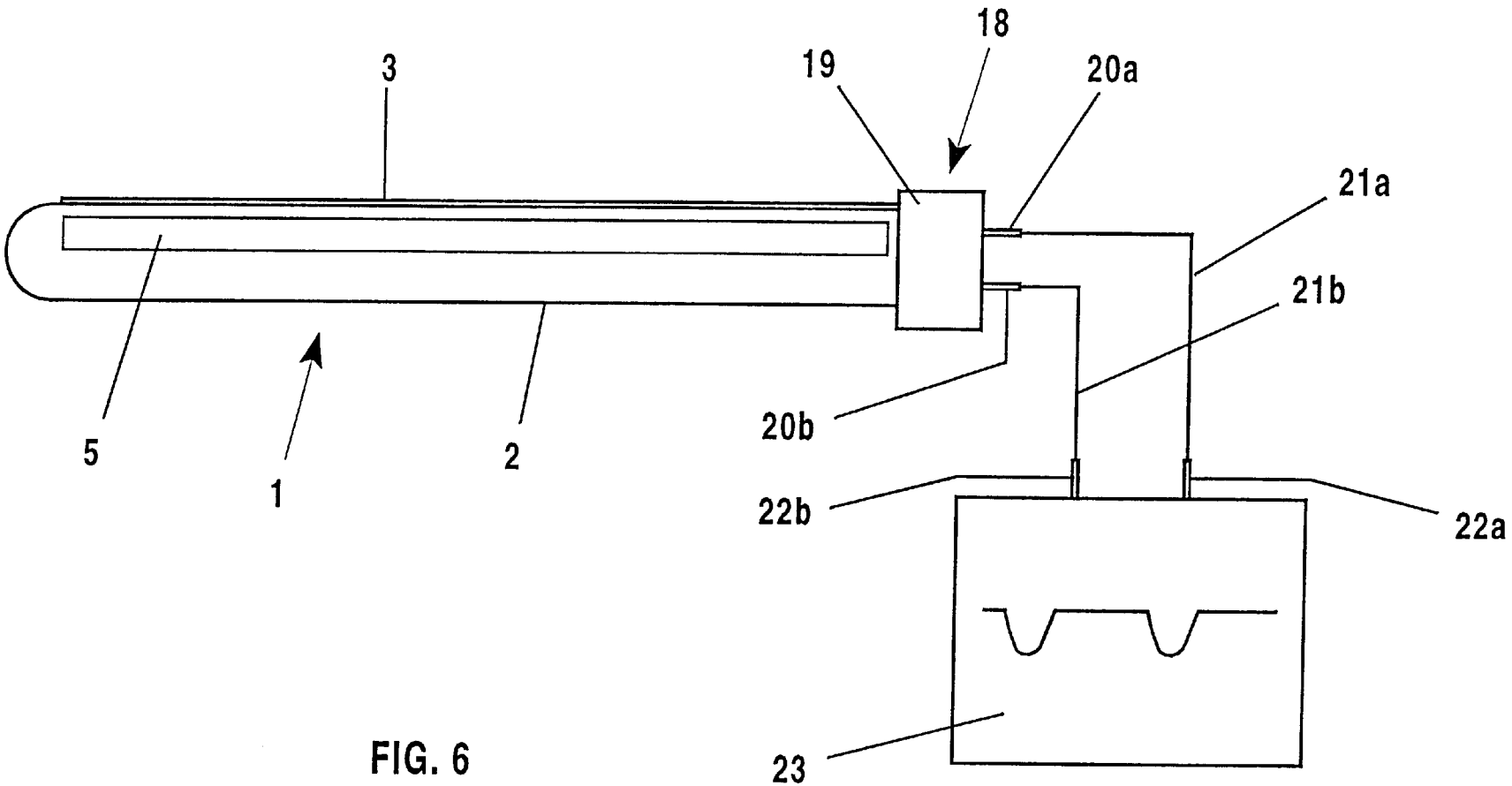
FIG. 6 shows a lighting system with an aperture fluorescent lamp and a pulsed voltage source.

FIG. 6 shows a lighting system for OA devices. The aperture fluorescent lamp 1 from FIG. 1 has at its second end in addition a cap 18. The cap 18 essentially comprises a cap pot 19 and two connecting pins 20*a*,20*b*. The cap pot 19 serves primarily to hold the lamp 1. In addition, the outer wall electrode 3 and the inner wall electrode 4 or the outer supply lead section 11 (compare FIG. 1) are connected to the two connecting pins 20*a*,20*b* in the interior of the cap pot 19 (not represented). The connecting pins 20*a*,20*b* are connected for their part via electric lines 21*a*,21*b* to the two poles 22*a*,22*b*, respectively, of a pulsed voltage source 23.

The pulsed voltage source 23 supplies a sequence of unipolar voltage pulses with a repetition frequency of 66 kHz. The pulse duration is approximately 1.1 Ws in each case.

Figure 7:
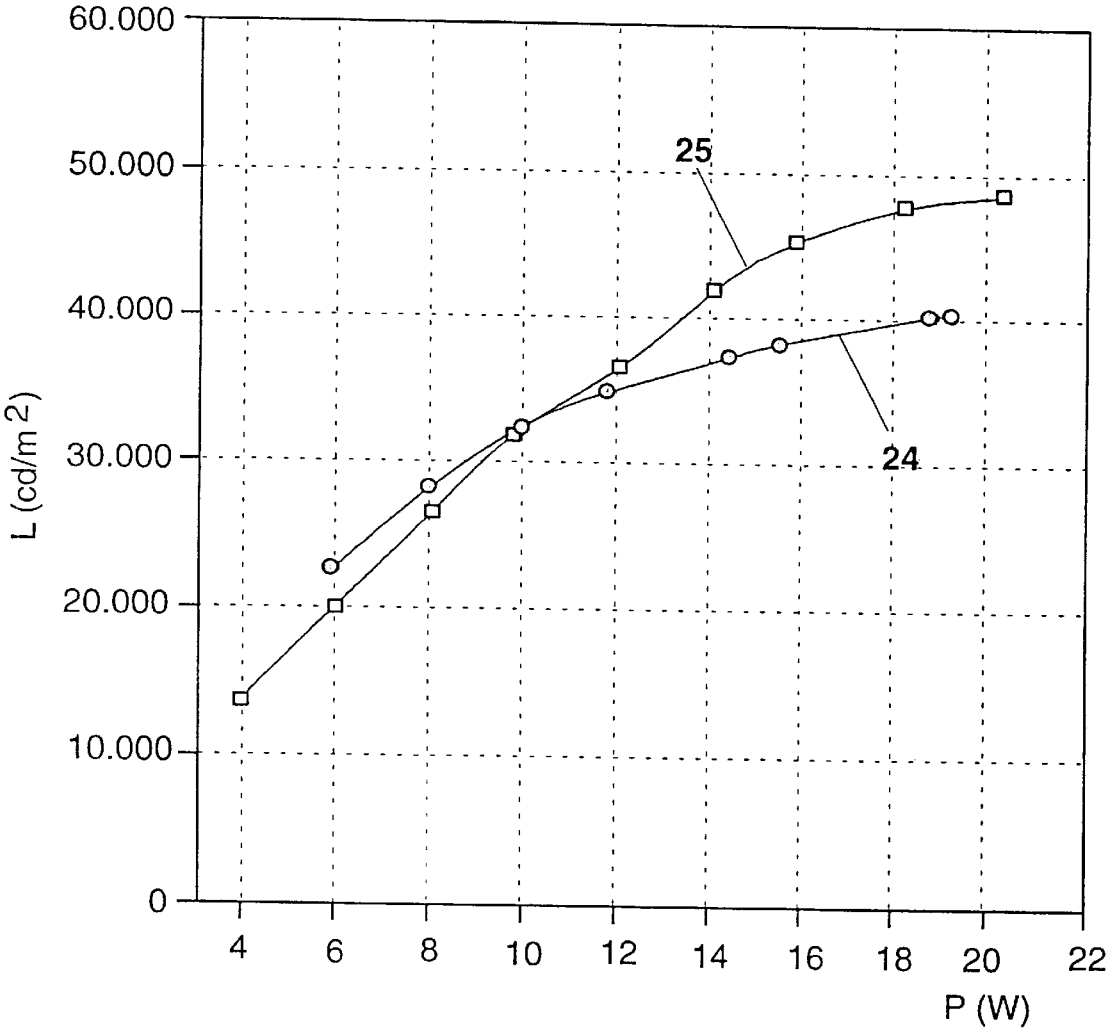
FIG. 7 shows measuring curves of the lamp from FIG. 1 and FIG. 3, respectively.

The luminous density L measured through the aperture in cd/m$^2$ is represented in FIG. 7 as a function of the time-averaged electric power P in W. The measuring curve 24 relates to a lighting system in accordance with FIG. 6 with the operating parameters specified there. As is to be seen, approximately 40,000 cd/m$^2$ is achieved in conjunction with a power of just 20 W. By contrast, a comparable conventional lamp in accordance with the teaching of U.S. Pat. No. 5,117,160 supplies only 20,000 cd/m$^2$ in conjunction with the same electric power. The lamp according to the invention therefore generates twice the luminous density for the same electric power; this corresponds to an increase of 100% by contrast with the prior art.

Figure 1B:
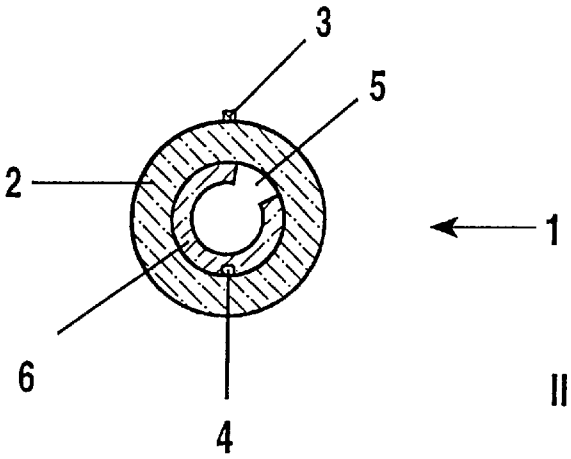
FIG. 1*b* shows a cross-section through the fluorescent lamp from FIG. 1*a,*

The measuring curve 25 is produced by replacing the lamp in accordance with FIG. 1 by the lamp in accordance with FIG. 3, that is to say a lamp with two anode strips instead of only one. Two discharge planes are therefore produced during operation (see also the description relating to FIG. 3). As is to be seen, starting from an electric power of approximately 10 W even higher luminous densities are obtained than in the case of the measuring curve 24. At a power of 20 W, finally, 50,000 cd/m$^2$ is just achieved. This corresponds to 2.5 times the luminous density as compared with the prior art, or an increase of 150%.

These results document the advantageous effect of the invention.

The invention is not restricted to the specified exemplary embodiments. In particular, combinations of features of various exemplary embodiments are also included.

What is claimed is:

1. A fluorescent lamp (1) having an at least partially transparent closed, tubular discharge vessel (2) which is filled with a gas filling and made from an electrically nonconducting material, which discharge vessel (2) has on its inner wall at least partially a layer of a fluorescent material or mixture of fluorescent materials (6), and having elongated electrodes (3; 4; 12; 14*a*–14*d*) arranged parallel to the longitudinal axis of the tubular discharge vessel (2), at least the electrode(s) of one polarity being separated by a dielectric (2; 13; 15*a*–15*d*) from the interior of the discharge vessel, characterized in that at least one electrode (4; 12; 14*a*–14*d*) is arranged on the inner wall of the discharge vessel (2), the at least one inner wall electrode (4; 12; 14*a*–14*d*) is additionally further constructed as a feedthrough (10) and the latter, in turn, is further constructed as an external supply lead (11), that is to say that each inner wall electrode (4), the associated feedthrough (10) thereof and associated external supply lead (11) are constructed in each case as functionally differing subregions of a unilateral common structure (4, 10, 11) resembling a conductor track.

2. The fluorescent lamp according to claim 1, characterized in that the tubular discharge vessel (2) is sealed in a gas-tight fashion at one or at both ends with a stopper (8) and by means of solder (9), the at least one inner wall electrode (4) being guided to the outside in a gas-tight fashion through the solder (9), that is to say that the inner wall electrode (4) merges into a feedthrough (10) in the region of the solder (9) and, finally, into an external supply lead (11) outside the vessel (2).

3. The fluorescent lamp according to claim 1, characterized in that the inner wall electrode(s) (12; 14*a*–14*d*) is (are)

covered additionally (in each case) with a dielectric layer (13; 15*a*–15*d*).

4. The fluorescent lamp (1) having an at least partially transparent closed, tubular discharge vessel (2) which is filled with a gas filling and made from an electrically nonconducting material, which discharge vessel (2) has on its inner wall at least partially a layer of a fluorescent material or mixture of fluorescent materials (17), and having elongated electrodes (3*a*; 3*b*; 16) arranged parallel to the longitudinal axis of the tubular discharge vessel (2), at least the electrode(s) of one polarity being separated by a dielectric (2) from the interior of the discharge vessel, characterized in that at least one electrode (16) is arranged inside the wall of the discharge vessel (2).

5. The fluorescent lamp according to claim 1, characterized in that the number of the electrodes of one polarity (4; 14*a*; 16) is different from the number of the electrodes of the other polarity (3*a*,3*b*; 14*b*–14*d*).

6. The fluorescent lamp according to claim 1, characterized in that the gas filling consists of an inert gas or inert gas mixture.

7. The fluorescent lamp according to claim 6, characterized in that the filling pressure is more than 100 torrs.

8. The fluorescent lamp according to claim 6, characterized in that the gas filling contains xenon.

9. The fluorescent lamp according to claim 1, characterized in that the inner wall of the discharge vessel (2) has an aperture (5) which is excepted from the fluorescent layer (6) and, if appropriate, a reflective layer (16).

10. The fluorescent lamp according to claim 9, characterized in that the electrodes are arranged asymmetrically with respect to the aperture (5).

11. The fluorescent lamp according to claim 10, characterized in that at least one electrode pair of differing polarity (3,5; 4,12; 3*a*,4; 14*a*,14*d*) is arranged in such a way that seen in cross-section the mid-vertical on the connecting line of an electrode pair (3,5; 4,12; 3*a*,4; 14*a*,14*d*) intersects the fluorescent layer (6), that is to say meets the inner wall outside the aperture (5).

12. The fluorescent lamp according to claim 9, characterized in that at least one reflective layer (16) for visible light is arranged between the inner wall and fluorescent layer (6).

13. The fluorescent lamp according to claim 12, characterized in that the at least one reflective layer (16) contains a layer made from $Al_2O_3$ and/or $TiO_2$.

14. The fluorescent lamp according to claim 1, characterized in that the inside diameter of the tubular discharge vessel (2) is less than 20 mm.

15. The fluorescent lamp according to claim 1, characterized in that the width of the electrodes is less than 2 mm.

16. A lighting system having a fluorescent lamp (1) and an electric pulsed voltage source (23) which is suitable for supplying during operation voltage pulses separated from one another by pauses, characterized in that the fluorescent lamp (1) has features of claim 1, the pulsed voltage source (23) being connected in an electrically conducting fashion to the two external supply leads of the fluorescent lamp (1).

17. The lighting system according to claim 16, characterized by the following operating parameters:

a repetition frequency of the voltage pulses of higher than 60 kHz, a pulse duration of the voltage pulses of less than 2 $\mu$s.

* * * * *